US007735169B2

(12) United States Patent
Wassilefsky

(10) Patent No.: US 7,735,169 B2
(45) **Date of Patent: *Jun. 15, 2010**

(54) COMFORT PILLOW

(75) Inventor: Gerda Wassilefsky, Odense V (DK)

(73) Assignee: Tempur-Pedic Management, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/198,537

(22) Filed: Aug. 26, 2008

(65) Prior Publication Data

US 2008/0307581 A1 Dec. 18, 2008

Related U.S. Application Data

(63) Continuation of application No. 11/443,460, filed on May 30, 2006, now Pat. No. 7,415,742, which is a continuation of application No. 10/489,233, filed as application No. PCT/US03/16486 on May 23, 2003, now Pat. No. 7,051,389.

(60) Provisional application No. 60/383,169, filed on May 24, 2002.

(51) Int. Cl.
*A47G 9/10* (2006.01)

(52) U.S. Cl. ..... 5/636; 5/655.9; 5/953; 5/490

(58) Field of Classification Search ..... 5/636, 5/644, 645, 490, 655.9, 953, 654, 655.4, 5/911

See application file for complete search history.

(56) References Cited

U.S. PATENT DOCUMENTS

| | | | |
|---|---|---|---|
| D28,903 | S | 6/1898 | Amory |
| 1,312,886 | A | 8/1919 | Bawden |
| 1,382,831 | A | 6/1921 | Hiker |
| D59,900 | S | 12/1921 | Marsh |
| 1,742,186 | A | 1/1930 | Claus |
| 1,876,591 | A | 9/1932 | Bawden |
| D94,702 | S | 2/1935 | Marks |
| 2,013,481 | A | 9/1935 | Stonehill |
| 2,056,767 | A | 10/1936 | Blath |
| 2,149,140 | A | 2/1939 | González-Rincones |
| 2,167,622 | A | 8/1939 | Bentivoglio |
| D126,825 | S | 4/1941 | Kolisch |
| 2,295,906 | A | 9/1942 | Lacour |
| 2,298,218 | A | 10/1942 | Madson |
| 2,522,120 | A | 9/1950 | Kaskey |

(Continued)

FOREIGN PATENT DOCUMENTS

| | | |
|---|---|---|
| DE | 1654301 | 11/1971 |

(Continued)

OTHER PUBLICATIONS

"Leg Cushion," OrthoSupport™ *Sleep Buddy*, http://www.orthosupport.com/sleep_buddy.htm, OrthoSupport International Co, 2000, 2 pages.

(Continued)

*Primary Examiner*—Robert G Santos
(74) *Attorney, Agent, or Firm*—Michael Best & Friedrich LLP

(57) ABSTRACT

A pillow. The pillow comprises a viscoelastic sleeve defining a cavity and a plurality of loose pieces of filler material substantially enclosed within the cavity.

28 Claims, 3 Drawing Sheets

U.S. PATENT DOCUMENTS

| | | | |
|---|---|---|---|
| 2,552,476 | A | 5/1951 | Barton |
| 2,700,779 | A | 2/1955 | Tolkowsky |
| 2,724,133 | A | 11/1955 | Sorrell |
| 2,759,200 | A | 8/1956 | Johnston |
| 2,765,480 | A | 10/1956 | Mueller |
| 2,835,905 | A | 5/1958 | Tomasson |
| 2,880,428 | A | 4/1959 | Forsland |
| 2,898,975 | A | 8/1959 | Wagner |
| 3,000,020 | A | 9/1961 | Lombard et al. |
| 3,047,517 | A | 7/1962 | Wherley |
| 3,047,888 | A | 11/1962 | Shecter et al. |
| 3,124,812 | A | 3/1964 | Milton et al. |
| 3,148,389 | A | 9/1964 | Lustig |
| 3,287,750 | A | 11/1966 | Jessup |
| 3,327,330 | A | 6/1967 | McCullough |
| D211,244 | S | 6/1968 | Hawley |
| 3,400,413 | A | 9/1968 | La Grossa |
| 3,469,882 | A | 9/1969 | Larsen |
| 3,574,397 | A | 4/1971 | Norriss |
| 3,604,023 | A | 9/1971 | Lynch |
| 3,606,461 | A | 9/1971 | Moriyama |
| 3,637,458 | A | 1/1972 | Parrish |
| 3,757,365 | A | 9/1973 | Kretchmer |
| D230,804 | S | 3/1974 | Lijewski |
| 3,795,018 | A | 3/1974 | Broaded |
| 3,829,917 | A | 8/1974 | De Laittre et al. |
| 3,833,259 | A | 9/1974 | Pershing |
| 3,837,021 | A | 9/1974 | Sellers et al. |
| 3,870,662 | A | 3/1975 | Lundberg |
| 3,896,062 | A | 7/1975 | Morehouse |
| 3,906,137 | A | 9/1975 | Bauer |
| D238,235 | S | 12/1975 | Elgebrandt |
| 3,939,508 | A | 2/1976 | Hall et al. |
| 3,987,507 | A | 10/1976 | Hall |
| 4,007,503 | A | 2/1977 | Watkin |
| 4,027,888 | A | 6/1977 | Wilcox |
| 4,060,863 | A | 12/1977 | Craig |
| 4,065,150 | A | 12/1977 | Van Auken |
| D247,312 | S | 2/1978 | Zeiss |
| 4,086,675 | A | 5/1978 | Talbert et al. |
| 4,118,813 | A | 10/1978 | Armstrong |
| 4,173,048 | A | 11/1979 | Varaney |
| 4,177,806 | A | 12/1979 | Griffin |
| 4,185,673 | A | 1/1980 | Daniello |
| 4,190,697 | A | 2/1980 | Ahrens |
| 4,218,792 | A | 8/1980 | Kogan |
| D258,557 | S | 3/1981 | Herr |
| D258,793 | S | 4/1981 | Rinz |
| D259,381 | S | 6/1981 | Smith |
| D260,125 | S | 8/1981 | Rogers |
| 4,374,172 | A | 2/1983 | Schwarz et al. |
| 4,379,856 | A | 4/1983 | Samaritter et al. |
| 4,454,309 | A | 6/1984 | Gould et al. |
| 4,480,346 | A | 11/1984 | Hawkins et al. |
| 4,496,535 | A | 1/1985 | Gould et al. |
| D278,779 | S | 5/1985 | Sink |
| D279,642 | S | 7/1985 | Ross |
| D282,427 | S | 2/1986 | O'Sullivan |
| 4,571,761 | A | 2/1986 | Perlin |
| 4,580,301 | A | 4/1986 | Ludman et al. |
| 4,584,730 | A | 4/1986 | Rajan |
| D284,724 | S | 7/1986 | Clark et al. |
| 4,606,088 | A | 8/1986 | Michaelsen et al. |
| 4,624,021 | A | 11/1986 | Hofstetter |
| 4,698,864 | A | 10/1987 | Graebe |
| 4,736,477 | A | 4/1988 | Moore |
| 4,748,768 | A | 6/1988 | Jacobsen |
| 4,754,510 | A | 7/1988 | King |
| 4,755,411 | A | 7/1988 | Wing et al. |
| 4,759,089 | A | 7/1988 | Fox |
| 4,773,107 | A | 9/1988 | Josefek |
| 4,773,142 | A | 9/1988 | Davis et al. |
| D298,198 | S | 10/1988 | O'Sullivan |
| 4,777,855 | A | 10/1988 | Cohen |
| 4,788,728 | A | 12/1988 | Lake |
| 4,799,275 | A | 1/1989 | Sprague, Jr. |
| 4,808,469 | A | 2/1989 | Hiles |
| 4,810,685 | A | 3/1989 | Twigg et al. |
| 4,821,355 | A | 4/1989 | Burkhardt |
| 4,826,882 | A | 5/1989 | Bredbenner et al. |
| 4,832,007 | A | 5/1989 | Davis, Jr. et al. |
| 4,840,430 | A | 6/1989 | Shimada |
| 4,842,330 | A | 6/1989 | Jay |
| 4,843,662 | A | 7/1989 | Handelman |
| D302,592 | S | 8/1989 | Holmes |
| 4,862,539 | A | 9/1989 | Bokich |
| 4,863,712 | A | 9/1989 | Twigg et al. |
| 4,864,669 | A | 9/1989 | Jones |
| D303,897 | S | 10/1989 | Phillips |
| D305,084 | S | 12/1989 | Gyebnar |
| D306,245 | S | 2/1990 | Akhtarekhavari |
| 4,899,405 | A | 2/1990 | Rothbard |
| 4,908,893 | A | 3/1990 | Smit |
| 4,910,818 | A | 3/1990 | Grabill et al. |
| 4,916,765 | A | 4/1990 | Castronovo, Jr. |
| D308,311 | S | 6/1990 | Forsland |
| D308,787 | S | 6/1990 | Youngblood |
| D309,689 | S | 8/1990 | Bool |
| 4,950,694 | A | 8/1990 | Hager |
| 4,959,880 | A | 10/1990 | Tesch |
| D314,116 | S | 1/1991 | Reed |
| 4,987,156 | A | 1/1991 | Tozune et al. |
| 5,006,569 | A | 4/1991 | Stone |
| 5,010,610 | A | 4/1991 | Ackley |
| 5,018,231 | A | 5/1991 | Wang |
| 5,018,790 | A | 5/1991 | Jay |
| 5,019,602 | A | 5/1991 | Lowe |
| 5,031,261 | A | 7/1991 | Fenner, Sr. |
| D319,751 | S | 9/1991 | Hoff |
| 5,049,591 | A | 9/1991 | Hayashi et al. |
| D320,715 | S | 10/1991 | Magnin et al. |
| 5,054,143 | A | 10/1991 | Javaher |
| 5,061,737 | A | 10/1991 | Hudson |
| D321,562 | S | 11/1991 | Ljungvall |
| 5,088,141 | A | 2/1992 | Meyer et al. |
| D325,839 | S | 5/1992 | Main |
| 5,114,989 | A | 5/1992 | Elwell et al. |
| 5,117,522 | A | 6/1992 | Everett |
| 5,121,515 | A | 6/1992 | Hudson |
| 5,123,133 | A | 6/1992 | Albert |
| 5,125,123 | A | 6/1992 | Engle |
| 5,138,732 | A | 8/1992 | Wattie et al. |
| 5,148,564 | A | 9/1992 | Reder |
| D333,938 | S | 3/1993 | Watson et al. |
| D334,318 | S | 3/1993 | Chee |
| 5,189,747 | A | 3/1993 | Mundy et al. |
| D336,809 | S | 6/1993 | Emery |
| 5,216,771 | A | 6/1993 | Hoff |
| 5,219,893 | A | 6/1993 | Konig et al. |
| 5,228,158 | A | 7/1993 | Park |
| 5,230,947 | A | 7/1993 | Ou |
| D341,509 | S | 11/1993 | Evans |
| 5,265,295 | A | 11/1993 | Sturgis |
| D342,411 | S | 12/1993 | Graebe |
| 5,294,181 | A | 3/1994 | Rose et al. |
| 5,317,773 | A | 6/1994 | Graebe |
| 5,363,524 | A | 11/1994 | Lang |
| 5,367,731 | A | 11/1994 | O'Sullivan |
| D354,356 | S | 1/1995 | Shiflett |
| D354,876 | S | 1/1995 | Pace |
| 5,382,602 | A | 1/1995 | Duffy et al. |
| 5,418,991 | A | 5/1995 | Shiflett |
| D358,957 | S | 6/1995 | Propp |
| D359,870 | S | 7/1995 | McLaughlin |

5,437,070 A 8/1995 Rempp
5,457,832 A 10/1995 Tatum
5,482,980 A 1/1996 Pcolinsky
D367,199 S 2/1996 Graebe
D367,390 S 2/1996 Johnston et al.
D369,663 S 5/1996 Gostine
5,522,106 A 6/1996 Harrison et al.
5,523,144 A 6/1996 Dyer, Jr.
5,528,784 A 6/1996 Painter
5,530,980 A 7/1996 Sommerhalter, Jr.
5,537,703 A 7/1996 Launder et al.
5,544,377 A 8/1996 Gostine
D374,146 S 10/1996 Bonaddio et al.
5,567,740 A 10/1996 Free
5,572,757 A 11/1996 O'Sullivan
D377,575 S 1/1997 Lowrey, Jr. et al.
5,591,780 A 1/1997 Muha et al.
5,638,564 A 6/1997 Greenawalt et al.
5,644,809 A 7/1997 Olson
D381,855 S 8/1997 Galick
D382,163 S 8/1997 Hartney
D383,026 S 9/1997 Torbik
5,664,271 A 9/1997 Ballavance
5,669,094 A 9/1997 Swanson
5,682,633 A 11/1997 Davis
5,687,436 A 11/1997 Denton
D387,235 S 12/1997 Carpenter
D388,648 S 1/1998 Bates
D388,649 S 1/1998 Chekuri
D388,650 S 1/1998 Davis
5,708,998 A 1/1998 Torbik
D390,405 S 2/1998 Jung
D391,112 S 2/1998 Houston
5,724,685 A 3/1998 Weismiller et al.
D393,564 S 4/1998 Liu
5,746,218 A 5/1998 Edge
D394,977 S 6/1998 Frydman
D395,568 S 6/1998 Davis
5,778,470 A 7/1998 Haider
5,781,947 A 7/1998 Sramek
D397,270 S 8/1998 Maalouf
5,797,154 A 8/1998 Contreras
D399,675 S 10/1998 Ferris
D402,150 S 12/1998 Wurmbrand et al.
5,848,448 A 12/1998 Boyd
D404,237 S 1/1999 Boyd
5,855,415 A 1/1999 Lilley, Jr.
5,884,351 A 3/1999 Tonino
D409,038 S 5/1999 Rojas, Jr. et al.
D410,810 S 6/1999 Lozier
D412,259 S 7/1999 Wilcox et al.
5,926,880 A 7/1999 Sramek
D415,920 S 11/1999 Denney
D416,742 S 11/1999 Sramek
D417,579 S 12/1999 Tarquinio
D417,997 S 12/1999 Yannakis
6,003,177 A 12/1999 Ferris
D418,711 S 1/2000 Mettler
6,017,601 A 1/2000 Amsel
6,018,831 A 2/2000 Loomos
6,034,149 A 3/2000 Bleys et al.
6,047,419 A 4/2000 Ferguson
6,049,927 A 4/2000 Thomas et al.
6,052,851 A 4/2000 Kohnle
6,079,066 A 6/2000 Backlund
6,093,468 A 7/2000 Toms et al.
D428,716 S 8/2000 Larger
D429,106 S 8/2000 Bortolotto et al.
6,115,861 A 9/2000 Reeder et al.
6,136,879 A 10/2000 Nishida et al.
D434,936 S 12/2000 May
6,154,905 A 12/2000 Frydman
6,156,842 A 12/2000 Hoenig et al.
6,159,574 A 12/2000 Landvik et al.
6,161,238 A 12/2000 Graebe
6,171,532 B1 1/2001 Sterzel
6,182,311 B1 2/2001 Buchanan et al.
6,182,312 B1 2/2001 Walpin
6,182,314 B1 2/2001 Frydman
D439,099 S 3/2001 Erickson
6,202,232 B1 3/2001 Andrei
6,202,239 B1 3/2001 Ward et al.
6,204,300 B1 3/2001 Kageoka et al.
6,226,818 B1 5/2001 Rudick
6,237,173 B1 5/2001 Schlichter et al.
6,241,320 B1 6/2001 Chew et al.
6,245,824 B1 6/2001 Frey et al.
D445,505 S 7/2001 Shapiro
6,253,400 B1 7/2001 Rüdt-Sturzenegger et al.
6,254,189 B1 7/2001 Closson
D446,305 S 8/2001 Buchanan et al.
6,292,964 B1 9/2001 Rose et al.
6,317,908 B1 11/2001 Walpin
6,321,402 B1 11/2001 Ming-Chung
6,327,725 B1 12/2001 Veilleux et al.
6,345,401 B1 2/2002 Frydman
6,347,421 B1 2/2002 D'Emilio
D455,311 S 4/2002 Fux
6,367,106 B1 4/2002 Gronsman
6,391,933 B1 5/2002 Mattesky
6,391,935 B1 5/2002 Hager et al.
6,401,283 B2 6/2002 Thomas et al.
6,408,467 B2 6/2002 Walpin
6,412,127 B1 7/2002 Cuddy
D463,701 S 10/2002 Borcherding et al.
6,471,726 B2 10/2002 Wang
D465,686 S 11/2002 Hwong
D466,750 S 12/2002 Landvik
D466,751 S 12/2002 Coats et al.
6,490,743 B1 12/2002 Adat et al.
6,491,846 B1 12/2002 Reese, II et al.
6,513,179 B1 2/2003 Pan
D471,750 S 3/2003 Jamvold et al.
6,541,094 B1 4/2003 Landvik et al.
D474,364 S 5/2003 Arcieri
D474,637 S 5/2003 Scheetz
6,574,809 B1 6/2003 Rathbun
6,578,220 B1 6/2003 Smith
6,583,194 B2 6/2003 Sendijarevic
6,594,838 B1 7/2003 Hollander et al.
6,602,579 B2 8/2003 Landvik
6,617,014 B1 9/2003 Thomson
6,617,369 B2 9/2003 Parfondry et al.
6,625,829 B2 9/2003 Zell
6,634,045 B1 10/2003 DuDonis et al.
6,635,688 B2 10/2003 Simpson
6,653,362 B2 11/2003 Toyota et al.
6,653,363 B1 11/2003 Tursi, Jr. et al.
6,663,537 B2 12/2003 McCoy
6,671,907 B1 1/2004 Zuberi
6,687,933 B2 2/2004 Habboub et al.
6,699,917 B2 3/2004 Takashima
6,701,558 B2 3/2004 VanSteenburg
D489,749 S 5/2004 Landvik
6,733,074 B2 5/2004 Groth
6,734,220 B2 5/2004 Niederoest et al.
6,742,207 B1 6/2004 Brown
6,751,818 B2 6/2004 Troop
6,756,415 B2 6/2004 Kimura et al.
6,779,211 B1 8/2004 Williams
D496,205 S 9/2004 Baddour
6,810,541 B1 11/2004 Woods
6,813,790 B2 11/2004 Flick et al.
6,845,534 B1 1/2005 Huang
6,848,128 B2 2/2005 Verbovszky et al.
6,857,151 B2 2/2005 Jusiak et al.

| | | | | |
|---|---|---|---|---|
| 6,866,915 | B2 | 3/2005 | Landvik | |
| 6,872,758 | B2 | 3/2005 | Simpson et al. | |
| D504,269 | S | 4/2005 | Faircloth | |
| 6,877,176 | B2 | 4/2005 | Houghteling | |
| 6,915,539 | B2 | 7/2005 | Rathbun | |
| 6,928,677 | B1 | 8/2005 | Pittman | |
| 6,966,090 | B2 | 11/2005 | McClintock et al. | |
| 7,051,389 | B2 | 5/2006 | Wassilefky | |
| 7,059,001 | B2 | 6/2006 | Woolfson | |
| D529,325 | S | 10/2006 | Maarbjerg | |
| 7,255,917 | B2 | 8/2007 | Rochlin et al. | |
| D558,499 | S | 1/2008 | Maarbjerg et al. | |
| 7,415,742 | B2 | 8/2008 | Wassilefsky | |
| 7,530,127 | B2 * | 5/2009 | Leifermann et al. | 5/636 |
| 7,594,288 | B1 * | 9/2009 | Holliday et al. | 5/636 |
| 2001/0000829 | A1 | 5/2001 | Thomas et al. | |
| 2001/0003219 | A1 | 6/2001 | Chou | |
| 2001/0018777 | A1 | 9/2001 | Walpin | |
| 2001/0027577 | A1 | 10/2001 | Frydman | |
| 2001/0032365 | A1 | 10/2001 | Sramek | |
| 2001/0054200 | A1 | 12/2001 | Romano et al. | |
| 2002/0018884 | A1 | 2/2002 | Thomson | |
| 2002/0019654 | A1 | 2/2002 | Ellis et al. | |
| 2002/0028325 | A1 | 3/2002 | Simpson | |
| 2002/0043736 | A1 | 4/2002 | Murakami et al. | |
| 2002/0088057 | A1 | 7/2002 | Wassilefsky | |
| 2002/0099106 | A1 | 7/2002 | Sendijarevic | |
| 2002/0112287 | A1 | 8/2002 | Thomas et al. | |
| 2002/0122929 | A1 | 9/2002 | Simpson et al. | |
| 2002/0124318 | A1 | 9/2002 | Loomos | |
| 2002/0128420 | A1 | 9/2002 | Simpson et al. | |
| 2003/0005521 | A1 | 1/2003 | Sramek | |
| 2003/0014820 | A1 | 1/2003 | Fuhriman | |
| 2003/0037376 | A1 | 2/2003 | Zell | |
| 2003/0045595 | A1 | 3/2003 | Toyota et al. | |
| 2003/0065046 | A1 | 4/2003 | Hamilton | |
| 2003/0087979 | A1 | 5/2003 | Bleys et al. | |
| 2003/0105177 | A1 | 6/2003 | Parfondry et al. | |
| 2003/0124337 | A1 | 7/2003 | Price et al. | |
| 2003/0131419 | A1 | 7/2003 | VanSteenburg | |
| 2003/0145384 | A1 | 8/2003 | Stelnicki | |
| 2003/0150061 | A1 | 8/2003 | Farley | |
| 2003/0182727 | A1 | 10/2003 | DuDonis et al. | |
| 2003/0186044 | A1 | 10/2003 | Sauniere et al. | |
| 2003/0188383 | A1 | 10/2003 | Ense | |
| 2003/0188385 | A1 | 10/2003 | Rathbun | |
| 2003/0192119 | A1 | 10/2003 | Verbovszky et al. | |
| 2003/0200609 | A1 | 10/2003 | Jusiak et al. | |
| 2003/0218003 | A1 | 11/2003 | Ellis et al. | |
| 2003/0229154 | A1 | 12/2003 | Kemmler et al. | |
| 2004/0000804 | A1 | 1/2004 | Groth | |
| 2004/0019972 | A1 | 2/2004 | Schecter et al. | |
| 2004/0044091 | A1 | 3/2004 | Niederoest et al. | |
| 2004/0087675 | A1 | 5/2004 | Yu | |
| 2004/0097608 | A1 | 5/2004 | Re'em | |
| 2004/0112891 | A1 | 6/2004 | Ellis et al. | |
| 2004/0139548 | A1 | 7/2004 | Hwang-Pao | |
| 2004/0139550 | A1 | 7/2004 | Calagui | |
| 2004/0142619 | A1 | 7/2004 | Ueno et al. | |
| 2004/0155498 | A1 | 8/2004 | Verbovszky et al. | |
| 2004/0155515 | A1 | 8/2004 | Verbovszky et al. | |
| 2004/0164499 | A1 | 8/2004 | Murakami et al. | |
| 2004/0181003 | A1 | 9/2004 | Murakami et al. | |
| 2004/0226098 | A1 | 11/2004 | Pearce | |
| 2004/0229970 | A1 | 11/2004 | Sasaki et al. | |
| 2004/0266897 | A1 | 12/2004 | Apichatachutapan et al. | |
| 2004/0266900 | A1 | 12/2004 | Neff et al. | |
| 2005/0000022 | A1 | 1/2005 | Houghteling | |
| 2005/0005358 | A1 | 1/2005 | DuDonis | |
| 2005/0005362 | A1 | 1/2005 | Verbovszky et al. | |
| 2005/0022307 | A1 | 2/2005 | McClintock et al. | |
| 2005/0038133 | A1 | 2/2005 | Neff et al. | |
| 2005/0043423 | A1 | 2/2005 | Schmidt et al. | |
| 2005/0060807 | A1 | 3/2005 | Kaizuka | |
| 2005/0060809 | A1 | 3/2005 | Rogers | |
| 2005/0066445 | A1 | 3/2005 | Christofferson et al. | |
| 2005/0076442 | A1 | 4/2005 | Wassilefky | |
| 2005/0140199 | A1 | 6/2005 | Kang et al. | |
| 2006/0277684 | A1 | 12/2006 | Wassilefky | |
| 2007/0044239 | A1 | 3/2007 | Leifermann et al. | |
| 2007/0113347 | A1 | 5/2007 | Lindell | |
| 2007/0245493 | A1 | 10/2007 | Leifermann et al. | |
| 2008/0307581 | A1 * | 12/2008 | Wassilefky | 5/636 |
| 2009/0070937 | A1 * | 3/2009 | Lindell | 5/636 |
| 2009/0205138 | A1 * | 8/2009 | Chen et al. | 5/691 |

FOREIGN PATENT DOCUMENTS

| | | | |
|---|---|---|---|
| DE | 3321720 | | 12/1984 |
| DE | 3803448 | C | 8/1988 |
| DE | 4040156 | C | 6/1992 |
| DE | 19960820 | | 6/2001 |
| DE | 10005919 | | 8/2001 |
| DE | 20207664 | U | 8/2002 |
| DE | 10237089 | | 2/2004 |
| DE | 202004003248 | | 5/2004 |
| DK | MR 1985 00079 | | 1/1985 |
| DK | MR 1985 00375 | | 5/1985 |
| EP | 0323742 | | 7/1989 |
| EP | 0361418 | B | 4/1990 |
| EP | 0365954 | B | 5/1990 |
| EP | 0433878 | B | 6/1991 |
| EP | 0486016 | | 5/1992 |
| EP | 0718144 | B | 6/1996 |
| EP | 0908478 | B | 4/1999 |
| EP | 0934962 | B | 8/1999 |
| EP | 0940621 | | 9/1999 |
| EP | 1021115 | | 7/2000 |
| EP | 1060859 | B | 12/2000 |
| EP | 1125719 | B | 8/2001 |
| EP | 1167019 | | 1/2002 |
| EP | 1184149 | B | 3/2002 |
| EP | 1188785 | | 3/2002 |
| EP | 0608626 | B | 8/2003 |
| EP | 1405867 | | 4/2004 |
| EP | 1507469 | | 2/2005 |
| FR | 2338721 | | 8/1977 |
| FR | 2396648 | B | 2/1979 |
| FR | 2415088 | B | 8/1979 |
| FR | 2598910 | | 11/1987 |
| FR | 2795371 | B | 12/2000 |
| FR | 2818187 | B | 6/2002 |
| FR | 2864483 | | 7/2005 |
| GB | 1273259 | | 3/1972 |
| GB | 2290256 | B | 12/1995 |
| GB | 2297057 | | 7/1996 |
| GB | 2314506 | | 1/1998 |
| GB | 2383958 | | 7/2003 |
| GB | 2414178 | | 11/2005 |
| IT | 1238272 | | 7/1993 |
| IT | 00224783 | | 6/1996 |
| JP | 52-106961 | | 9/1977 |
| JP | 62-183790 | | 12/1987 |
| JP | 3128006 | | 5/1991 |
| JP | H9-37909 | | 7/1995 |
| JP | H7-327786 | | 12/1995 |
| JP | 10-295498 | | 11/1998 |
| JP | 2000-139653 | | 5/2000 |
| JP | 2002-306283 | | 10/2002 |
| KR | 10-2002-60116 | | 7/2002 |
| RU | 2145181 | | 10/2000 |
| SE | 457327 | C | 12/1988 |
| WO | WO 8504150 | | 9/1985 |
| WO | WO 8607528 | | 12/1986 |
| WO | WO 9208759 | | 5/1992 |
| WO | WO 9321806 | | 11/1993 |

| | | |
|---|---|---|
| WO | WO 9401023 | 1/1994 |
| WO | WO 9416935 | 8/1994 |
| WO | WO 9518184 | 7/1995 |
| WO | WO 9519755 | 7/1995 |
| WO | WO 9520622 | 8/1995 |
| WO | WO 9528861 | 11/1995 |
| WO | WO 9529658 | 11/1995 |
| WO | 0713900 B | 5/1996 |
| WO | WO 9803333 | 1/1998 |
| WO | WO 9804170 | 2/1998 |
| WO | WO 9841126 | 9/1998 |
| WO | WO 9845359 | 10/1998 |
| WO | WO 9850251 | 11/1998 |
| WO | WO 9902077 | 1/1999 |
| WO | WO 9908571 | 2/1999 |
| WO | WO 9915126 | 4/1999 |
| WO | WO 9944856 | 9/1999 |
| WO | WO 9952405 | 10/1999 |
| WO | WO 0017836 | 3/2000 |
| WO | WO 0062850 | 10/2000 |
| WO | WO 0105279 | 1/2001 |
| WO | WO 0116217 | 3/2001 |
| WO | WO 0125305 | 4/2001 |
| WO | WO 0128388 | 4/2001 |
| WO | WO 0132736 | 5/2001 |
| WO | WO 0143602 | 6/2001 |
| WO | WO 0147340 | 7/2001 |
| WO | WO 0156432 | 8/2001 |
| WO | WO 0157104 | 8/2001 |
| WO | WO 0170167 | 9/2001 |
| WO | WO 0179323 | 10/2001 |
| WO | WO 0200157 | 1/2002 |
| WO | WO 0246258 | 6/2002 |
| WO | WO 02051900 | 7/2002 |
| WO | WO 02051902 | 7/2002 |
| WO | WO 02062891 | 8/2002 |
| WO | WO 02077056 | 10/2002 |
| WO | WO 02088211 | 11/2002 |
| WO | WO 03000770 | 1/2003 |
| WO | WO 03054047 | 3/2003 |
| WO | WO 03046041 | 6/2003 |
| WO | WO 03066766 | 8/2003 |
| WO | WO 03070061 | 8/2003 |
| WO | WO 03072391 | 9/2003 |
| WO | WO 03099079 | 12/2003 |
| WO | WO 2004020496 | 3/2004 |
| WO | WO 2004034847 | 4/2004 |
| WO | WO 2004036794 | 4/2004 |
| WO | WO 2004039858 | 5/2004 |
| WO | WO 2004055624 | 7/2004 |
| WO | WO 2004063088 | 7/2004 |
| WO | WO 2004082436 | 9/2004 |
| WO | WO 2004089682 | 10/2004 |
| WO | WO 2004100829 | 11/2004 |
| WO | WO 2004108383 | 12/2004 |
| WO | WO 2005003205 | 1/2005 |
| WO | WO 2005003206 | 1/2005 |
| WO | WO 2005031111 | 4/2005 |
| WO | WO 2005042611 | 5/2005 |
| WO | WO 2005046988 | 5/2005 |
| WO | WO 2005065245 | 7/2005 |
| WO | WO 2005089297 | 9/2005 |

OTHER PUBLICATIONS

"Sleep Buddy™ Plus," OrthoSupport™ *Sleep Buddy Plus*, http://www.orthosupport.com/OL1032.htm, OrthoSupport International Co, 2000, 3 pages.

*Supple-Pedic* pillow, Strobel Technolgies, "Pillow Park Plaza," http://www.pillowpark.com/mat.asp, p. 2 (printed Jun. 27, 2000).

*Isotonic* pillow, Carpenter Co., http://www.carpenter.com/consumer/isotonic.htm, p. 1 (printed Jun. 27, 2000).

*BackSaver* All Position Pillow, BackSaver, Backsaver.com 2000, . . . /pg__product__detail.cfm?TID=23240507137636002706837 9&CFID=96050713&CFTOK, p. 1 (printed Jun. 27, 2000).

Bay Jacobsen *ViscoFlex, CombiFlex,* Standard, Back Support, and Anatomical Sitting Wedge pillows, http://www.bayjacobsen.dk/content.asp?id=33, pp. 3 and 4 (printed Jun. 27, 2000).

"Advanced Comfort abed.com Pillows and Accessories," Advanced Comfort Mattresses, http://www.abed.com/cpillow.htm, p. 1 (printed Jun. 27, 2000).

"Supple-Pedic Pillows and Cushions," Strobel Technologies, http://www.strobelcom/supplepillow.htm, pp. 1 and 2 (printed Jun. 27, 2000).

"Splintek *SleepRight* Side Sleeping Pillow," http://www.splintek.com/ph/chirocontour.html, 2005 Splintek PP-Inc., pp. 1-3 (printed Nov. 14, 2005).

Sinomax.com.hk Home page, including picture of Sinomax® My Beauty Pillow, http://www.sinomax.com.hk/en/home.html, 2003 Sinomax (Holding) Group Ltd., p. 1 (printed Dec. 13, 2004).

Sinomax.com.hk "About Us" link, narrative for Sinomax® Sinomax (Holding) Group "TV-228 My Beauty Pillow," http://www.sinomax.com.hk/en/oem/product/bedroom/pillow/detail.html?id=2337, 2003 Sinomax (Holding) Group Ltd., p. 1 (printed Dec. 13, 2004).

Sinomax.com.hk "Export" page, narrative for Sinomax® Sinomax (Holding) Group "Export— New & Hot Products," including, among other things, pillows and cushions, http://www.sinomax.com.hk.en.oem.overview.html, 2003 Sinomax (Holding) Group Ltd., pp. 1-3 (printed Dec. 13, 2004).

Canadian Office Action issued in corresponding Canadian Patent Application No. 2,616,950.

Japanese Office Action issued in corresponding Japanese Patent Application No. 2004-506611.

* cited by examiner

COMFORT PILLOW

CROSS-REFERENCE TO RELATED APPLICATIONS

This is a continuation application of U.S. patent application Ser. No. 11/443,460 filed on May 30, 2006 and issued on Aug. 26, 2008 as U.S. Pat. No. 7,415,742, which is a continuation of U.S. patent application Ser. No. 10/489,233 filed on Mar. 10, 2004 and issued on May 30, 2006 as U.S. Pat. No. 7,051,389, which is a 35 U.S.C. §371 National Stage Entry Application of PCT Application Number PCT/US03/16486 filed on May 23, 2003, which claims priority to U.S. Provisional Patent Application Ser. No. 60/383,169 filed on May 24, 2002. Priority is hereby claimed to all of these patent applications, the entire contents of which are incorporated herein by reference.

FIELD OF THE INVENTION

This invention relates generally to pillows or cushions, and more particularly to a pillow or cushion for therapeutic use.

BACKGROUND OF THE INVENTION

The neck of a person lying in a supine or sidelying position is often out of alignment with the person's spine. This is commonly the case when the person's neck is supported by a pillow or multiple pillows such that the neck lies at an angle defined by the deflected height of the pillow(s), and this angle is typically not co-planar with the spine. The deflected height of the pillow is closely related to its stiffness, which is conventionally provided by filling material disposed within a fabric covering. Conventional filling material can include feathers, cotton, or a synthetic filler.

SUMMARY OF THE INVENTION

To provide a pillow structure more likely to properly align the user's neck and spine, the invention provides a pillow having multiple foam components.

One embodiment of the present invention includes a pillow having a viscoelastic sleeve defining a cavity and a plurality of loose pieces of filler material substantially enclosed within the cavity.

Another embodiment of the present invention includes a pillow having a first layer of viscoelastic material and a second layer of viscoelastic material. The first and second layers couple together to form a cavity therebetween. A plurality of loose pieces of filler material is positioned between the first and second layers and is enclosed within the cavity.

Yet another embodiment of the present invention includes a method of manufacturing a pillow including coupling a first peripheral edge of a first panel of viscoelastic material to a second peripheral edge of a second panel of viscoelastic material and enclosing a plurality of loose pieces of filler material between and within the first and second panels of viscoelastic material.

The viscoelastic foam responds to changes in temperature such that body heat molds the pillow to conform to the curves of a body for comfort and support. This allows the shape of the pillow to more closely follow the contours of the body and to promote an improved alignment of the neck and spine when a person is in a supine or sidelying position.

A cover preferably encases the pillow and contours to the shape of the pillow. The cover is removable, washable, and has a resealable slot through which the pillow may be inserted or removed. The slot extends across an edge portion of the pillow and is preferably opened and closed by a zipper.

DETAILED DESCRIPTION

Figure 1:
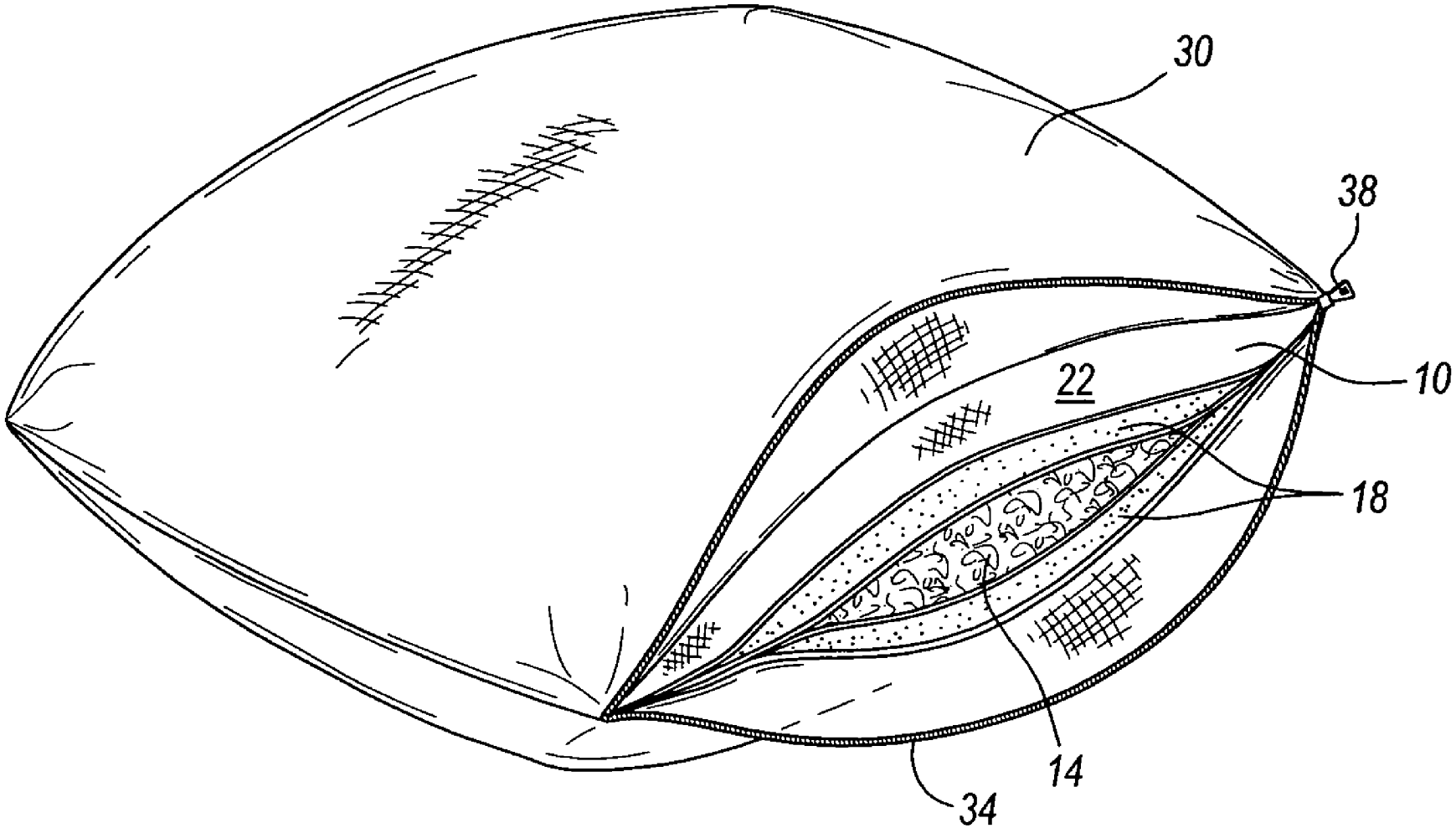
FIG. 1 is a perspective view illustrating a pillow embodying the present invention.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

Figure 2:
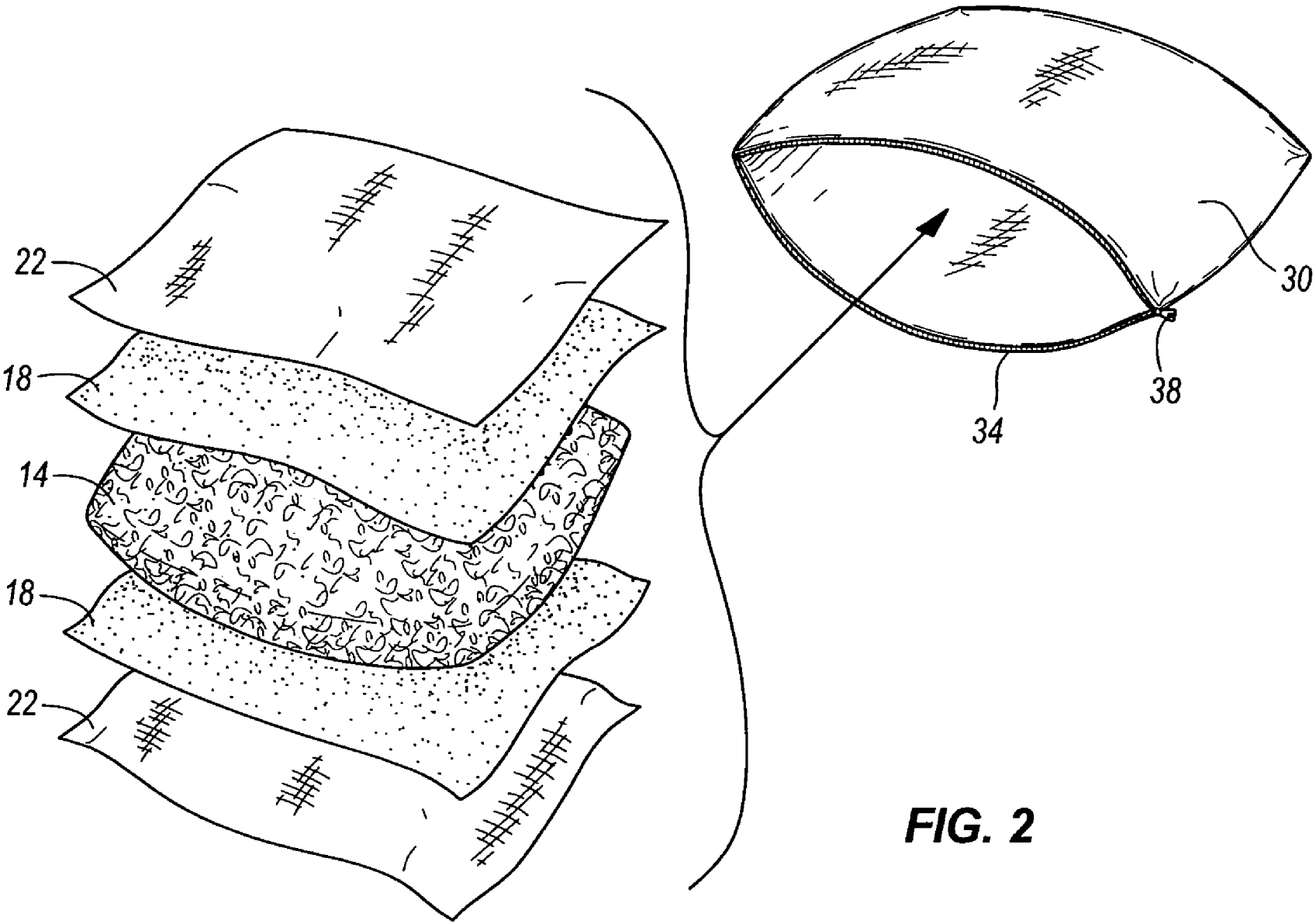
FIG. 2 is an exploded view of the pillow shown in FIG. 1.
Figure 3:
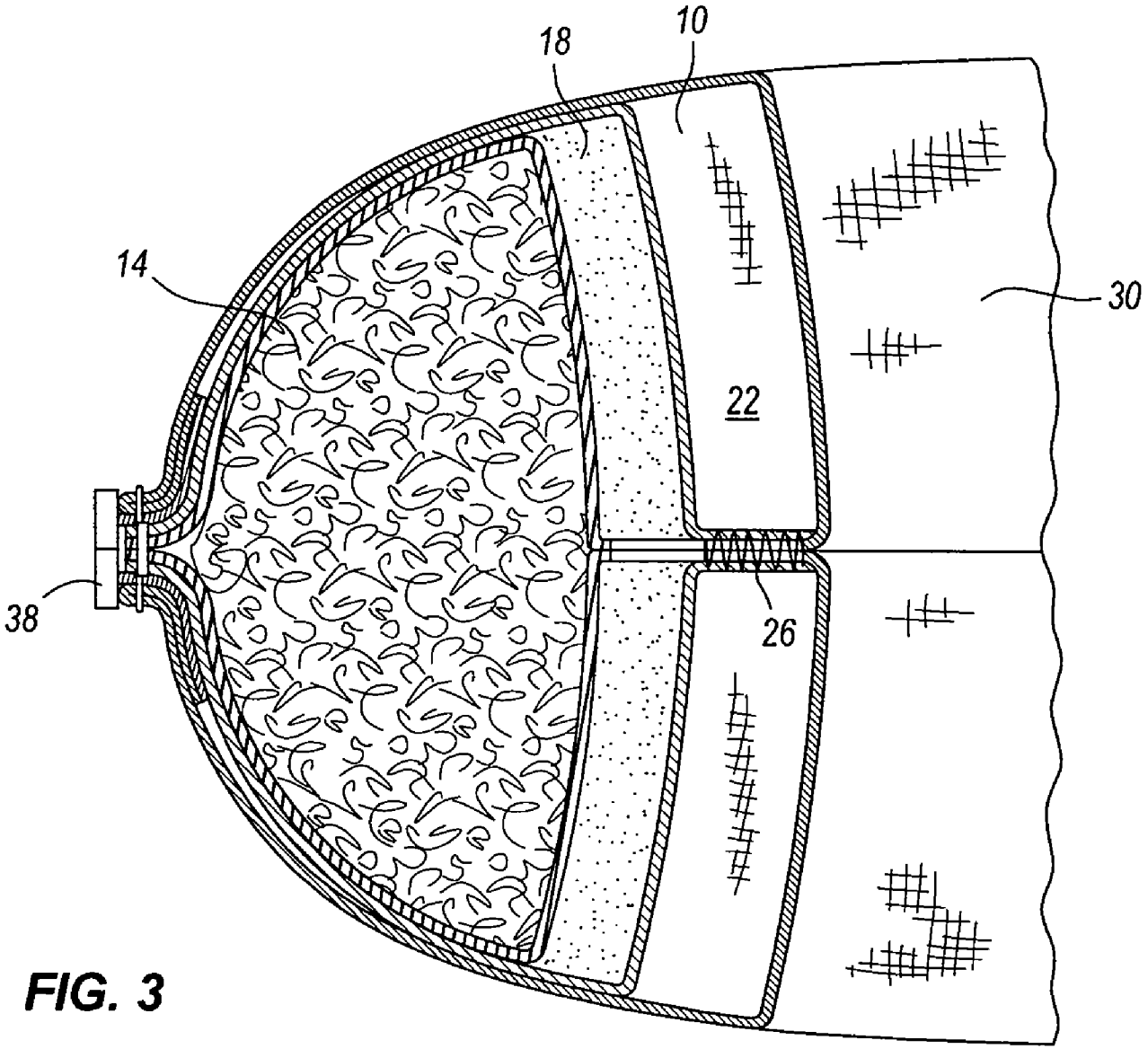
FIG. 3 is a partial cross-sectional view of the pillow shown in FIG. 1.

FIGS. 1-3 illustrate a pillow 10 of the present invention having a sleeve construction formed of multiple layers. The pillow 10 comprises a filler material 14 disposed between layers of viscoelastic foam 18. The viscoelastic foam layers 18 possess specific thermally responsive properties which cause the pillow 10 to conform to the shape of the portion of a person's body that contacts the pillow 10. The viscoelastic foam layers 18 have a lower stiffness or hardness at an elevated temperature as compared to the stiffness at a cooler temperature. Conversely, conventional pillow filler materials typically have a constant stiffness with respect to a changing temperature. The body heat of the person acts to soften the portion of the pillow 10 in contact with the body, while the portion of the pillow 10 not contacting the body remains more firm. As a result, the pillow 10 embodying the present invention allows for greater comfort over a conventional pillow by accommodating each user's body form.

In one embodiment of the present invention, the filler material 14 is granulated, or shredded, viscoelastic foam having a density of about 85 kg/m$^3$. However, a suitable density for the viscoelastic foam filler material 14 for an average weight pillow 10, for example, can be between about 30 and about 140 kg/m$^3$. Further, a suitable density for the viscoelastic foam filler material 14 for a light-weight pillow 10, for example, can be less than about 40 kg/m$^3$. Likewise, a suitable density for the viscoelastic foam filler material 14 for a heavy-weight pillow 10, for example, can be greater than about 130 kg/m$^3$. Alternatively, the granulated viscoelastic foam utilized as the filler material 14 can have any density in accordance with the desired characteristics of the pillow 10. In addition, a suitable viscoelastic foam filler material 14 possesses an indentation load deflection, or "ILD," of 65% between 100-500 N loading, and a maximum 10% rebound according to the test procedure governed by the ASTM-D-1564 standard.

The granulated filler material 14 can be made up of recycled, virgin, or scrap viscoelastic material. The granulated filler material 14 may consist of pieces of a nominal length, or the granulated filler material 14 may consist of pieces of varying lengths. For example, granulated filler material 14 may have a nominal length of about 1.3 cm. Also, granulated filler material 14 may consist of varying lengths between about 0.6 cm and about 2 cm. The granulated filler material 14 can be as short as 0.3 cm and as long as 4 cm., or the filler material 14 can be any length in accordance with the desired characteristics of the pillow 10. In one preferred embodiment of the invention, the granulated filler material 14 is comprised of 16-20% having a length longer than 2 cm, 38-42% having a length between 1 and 2 cm, and 38-42% of the pieces shorter than 1 cm. Significant cost savings and waste reduction can be realized by using scrap or recycled filler material 14 rather than virgin filler material 14. The viscoelastic foam used as the filler material 14 is made from a polyurethane foam material, however, the filler material 14 can be made from any other viscoelastic polymer material that exhibits similar thermally-responsive properties.

The composition of the filler material 14 can be varied to alter the characteristics of the pillow 10 and the cost of the pillow 10. In another embodiment of the present invention, the filler material 14 is a combination of granulated viscoelastic foam and a fiber material. The fiber material can be made from any kind of textile, such as an organic textile (cotton) or a synthetic textile, which is often less expensive than viscoelastic foam. In one embodiment of the present invention, the fiber material has a density of about 1 g/cm$^3$. However, a suitable density for the fiber material for an average weight pillow 10, for example, is 0.1-2 g/cm$^3$. Further, a suitable density for the fiber material for a light-weight pillow 10, for example, can be less than about 0.3 g/cm$^3$. Likewise, a suitable density for the fiber material for a heavy-weight pillow 10, for example, can be greater than about 1.8 g/cm$^3$. Alternatively, the fiber material utilized in combination with the granulated viscoelastic foam as the filler material 14 can have any density in accordance with the desired characteristics of the pillow 10.

In one preferred embodiment of the invention, the filler material 14 is comprised of about 50% fiber material, while the remaining composition includes the granulated viscoelastic foam. However, a suitable range of fiber material in the filler material 14 for an average-cost pillow 10, for example, can be between about 20% and about 80%. Further, a suitable range of fiber material in the filler material 14 for a more expensive pillow 10, for example, can be more than about 30% of the filler material 14. Likewise, a suitable range of fiber material in the filler material 14 for a less expensive pillow 10, for example, can be greater than about 70% of the filler material 14.

In yet another embodiment of the present invention, the filler material 14 is a combination of granulated viscoelastic foam and polystyrene balls, which are often less expensive than viscoelastic foam. The filler material 14 of this embodiment can also include an organic or synthetic fiber material depending on the desired characteristics of the pillow 10. The polystyrene balls may consist of balls of a nominal diameter, or the polystyrene balls may consist of balls of varying diameters. For example, the polystyrene balls may have a nominal diameter of about 5 mm. Also, the polystyrene balls may consist of varying diameters between about 1 mm and about 10 mm. The polystyrene balls can also be as small as 0.5 mm and as long as 20 mm, or the polystyrene balls can be any length in accordance with the desired characteristics of the pillow 10.

In one preferred embodiment of the invention, the filler material 14 is comprised of about 50% polystyrene balls, while the remaining composition includes the granulated viscoelastic foam. However, a suitable range of polystyrene balls in the filler material 14 for an average-cost pillow 10, for example, can be between about 20% and about 80%. Further, a suitable range of polystyrene balls in the filler material 14 for a more expensive pillow 10, for example, can be less than about 30% of the filler material 14. Likewise, a suitable range of polystyrene balls in the filler material 14 for a less expensive pillow 10, for example, can be greater than about 70% of the filler material 14.

In another embodiment of the present invention, the filler material 14 can also include granulated highly-elastic ("HE") foam in addition to the granulated viscoelastic foam. HE foam is often less expensive than viscoelastic foam, thus yielding a potentially less expensive pillow 10. The filler material can be comprised of any single filler described above or any combination of the fillers. Alternatively, the filler material 14 can also include any conventional materials, such as feathers, granulated cotton, cotton fibers, etc. In one embodiment of the present invention, the filler material 14 includes HE foam having a density of about 35 kg/m$^3$. However, a suitable density for the HE foam for an average weight pillow 10, for example, can be between about 20 and about 50 kg/m$^3$. Further, a suitable density for the HE foam for a lightweight pillow 10, for example, can be less than about 25 kg/m$^3$. Likewise, a suitable density for the HE foam for a heavyweight pillow 10, for example, can be greater than about 45 kg/m$^3$. Alternatively, the HE foam utilized in the filler material 14 can have any density in accordance with the desired characteristics of the pillow 10.

The granulated HE foam may consist of pieces of a nominal length, or the granulated HE foam may consist of pieces of varying lengths. For example, the granulated HE foam may have a nominal length of about 1.3 cm. Also, the granulated HE foam may consist of varying lengths between about 0.6 cm and about 2 cm. The granulated HE foam can be as short as 0.3 cm and as long as 4 cm., or the granulated HE foam can be any length in accordance with the desired characteristics of the pillow 10. In one preferred embodiment of the invention, the granulated HE foam is comprised of 16-20% having a length longer than 2 cm, 38-42% having a length between 1 and 2 cm, and 38-42% of the pieces shorter than 1 cm.

In one preferred embodiment of the invention, the filler material 14 is comprised of about 50% granulated HE foam, while the remaining composition includes the granulated viscoelastic foam. However, a suitable range of HE foam in the filler material 14 for an average cost pillow 10, for example, is 20%-80%. Further, a suitable range of granulated HE foam in the filler material 14 for a more expensive pillow 10, for example, can be less than about 30% of the filler material 14. Likewise, a suitable range of granulated HE foam in the filler material 14 for a less expensive pillow 10, for example, can be greater than about 70% of the filler material 14.

As previously mentioned, the filler material 14 is disposed between layers of viscoelastic foam 18. In one embodiment of the present invention, the layers of viscoelastic foam 18 have a density of about 85 kg/m$^3$. However, a suitable density for the layers of viscoelastic foam 18 for an average weight pillow 10, for example, can be between about 30 and about 140 kg/m$^3$. Further, a suitable density for the layers of viscoelastic foam 18 for a lightweight pillow 10, for example, can be less than about 40 kg/m$^3$. Likewise, a suitable density for the layers of viscoelastic foam 18 for a heavyweight pillow 10, for example, can be greater than about 130 kg/m$^3$. Alternatively, the layers of viscoelastic foam 18 can have any density in accordance with the desired characteristics of the pillow 10.

The layers of viscoelastic foam 18 are preferably about 10 mm thick and have thermally-responsive properties similar to the granulated viscoelastic foam of the filler material 14. Likewise, a suitable thickness for the layers of viscoelastic foam 18 for an average weight pillow 10, for example, can be between about 5 mm and 15 mm. However, a suitable thickness for the layers of viscoelastic foam 18 for a lightweight pillow 10, for example, can be less than about 7 mm. Further, a suitable thickness for the layers of viscoelastic foam 18 for a heavyweight pillow 10, for example, can be greater than about 13 mm. The layers of viscoelastic foam 18 are made from a polyurethane foam material, however, the layers of viscoelastic foam 18 can be made from any other viscoelastic polymer material that exhibits similar thermally-responsive properties.

The overall stiffness or hardness of the pillow 10 is dependent on the stiffness of the individual viscoelastic foam layers 18 and the filler material 14. As such, the overall stiffness or hardness of the pillow 10 may be affected by varying the stiffness of the individual viscoelastic foam layers 18 and/or the filler material 14.

As shown in FIGS. 1-3, reinforcing fabric layers 22 are positioned on the outside of the layers of viscoelastic foam 18. The reinforcing fabric 22 acts as an anchor for stitches 26 that secure together the layers of reinforcing fabric 22 and the layers of viscoelastic foam 18. Without the reinforcing fabric layers 22, the viscoelastic foam layers 18, which are less durable than the layers of reinforcing fabric 22, would have to directly anchor the stitches 26 such that the filler material 14 is secured between the viscoelastic foam layers 18. In a pillow having this construction (not shown), the viscoelastic foam layers 18 would likely tear near the stitches 26 as a result of normal use of the pillow. Further, if the viscoelastic foam layers 18 were to tear, then the filler material 14 would spill out. Therefore, the reinforcing fabric layers 22 provide a measure of durability to the pillow 10. The reinforcing fabric 22 is preferably made from a durable material, such as a cotton/polyester blend.

A cover 30 surrounds and encases the pillow 10, and conforms to the shape of the pillow 10. The cover 30 is preferably made from a durable and washable fabric material, such as a cotton/polyester blend. As shown in FIG. 1, a slot 34 extends across the cover 30 along the cover's edge. The pillow 10 may be inserted into the cover 30 through the slot 34. The pillow 10 may also be removed from the cover 30 through the slot 34 to facilitate cleaning of the cover 30. The slot 34 is resealable to close the cover 30 around the pillow 10 and to open the cover 30 for removing the pillow 10. A closure device is used to open and close the slot 34. In the preferred embodiment, the closure device is a zipper 38, although the closure device could also comprise snaps, buttons, hook and loop fasteners, overlapping flaps, laces, or other similar fasteners.

During manufacture, the layers of viscoelastic foam 18 are sewn together with the layers of reinforcing fabric 22 to form a sleeve or casing having an open end, wherein the layers of viscoelastic foam 18 comprise the inner layers of the casing and the layers of reinforcing fabric 22 comprise the outer layers of the casing. The filler material 14 is then inserted through the open end of the casing until the desired amount of filler material 14 is reached within the casing. The open end is then sewn closed, thereby encasing the filler material 14 within the casing and defining a pillow 10. The pillow 10 is then inserted within the cover 30 and the cover 30 is closed by the zipper 38.

I claim:

1. A pillow comprising:

a viscoelastic sleeve defining a cavity; and a plurality of loose pieces of filler material substantially enclosed within the cavity.

2. The pillow of claim 1, further comprising a cover substantially enclosing the sleeve.

3. The pillow of claim 2, wherein the cover comprises a resealable fastener through which access to the sleeve is obtained.

4. The pillow of claim 1, wherein the sleeve comprises first and second panels of material joined together at peripheral seams to define the internal cavity.

5. The pillow of claim 1, wherein the viscoelastic sleeve has a density between about 30 kg/m$^3$ and about 140 kg/m$^3$.

6. The pillow of claim 1, wherein the plurality of loose pieces of filler material has a nominal length between about 0.6 cm and about 2 cm.

7. The pillow of claim 6, wherein the plurality of loose pieces of filler material has a nominal length of about 1.3 cm.

8. The pillow of claim 1, wherein approximately 16% to 20% of the plurality of loose pieces of filler material includes lengths longer than about 2 cm.

9. The pillow of claim 1, wherein approximately 38% to 42% of the plurality of loose pieces of filler material includes lengths between about 1 cm and about 2 cm.

10. The pillow of claim 1, wherein approximately 38% to 42% of the plurality of loose pieces of filler material includes lengths shorter than about 1 cm.

11. The pillow of claim 1, wherein the filler material further includes a plurality of balls.

12. The pillow of claim 1, wherein the filler material further includes highly-elastic foam.

13. A pillow comprising:

a first layer of viscoelastic material; and a second layer of viscoelastic material, the first and second layers coupled together to form a cavity therebetween;

wherein a plurality of loose pieces of filler material is positioned between the first and second layers and is enclosed within the cavity.

14. The pillow of claim 13, wherein the first and second layers of viscoelastic material are sewn together.

15. The pillow of claim 13, further comprising a cover substantially enclosing the first and second layers of viscoelastic material and the plurality of loose pieces of filler material.

16. The pillow of claim 15, wherein the cover comprises a resealable fastener through which access to the first and second layers of viscoelastic material is obtained.

17. The pillow of claim 13, wherein the viscoelastic material of the first and second layers has a density between about 30 kg/m$^3$ and about 140 kg/m$^3$.

18. The pillow of claim 13, wherein the plurality of loose pieces of filler material has a nominal length between about 0.6 cm and about 2 cm.

19. The pillow of claim 13, wherein the plurality of loose pieces of filler material has a nominal length of about 1.3 cm.

20. The pillow of claim 13, wherein approximately 16% to 20% of the plurality of loose pieces of filler material includes lengths longer than about 2 cm.

21. The pillow of claim 13, wherein approximately 38% to 42% of the plurality of loose pieces of filler material includes lengths between about 1 cm and about 2 cm.

22. The pillow of claim 13, wherein approximately 38% to 42% of the plurality of loose pieces of filler material includes lengths shorter than about 1 cm.

23. The pillow of claim 13, wherein the filler material further includes a plurality of balls.

24. The pillow of claim 13, wherein the filler material further includes highly-elastic foam.

25. A method of manufacturing a pillow comprising:

coupling a first peripheral edge of a first panel of viscoelastic material to a second peripheral edge of a second panel of viscoelastic material; and enclosing a plurality of loose pieces of filler material between and within the first and second panels of viscoelastic material.

26. The method of claim 25, further comprising inserting the plurality of loose pieces of filler material between the first and second panels after coupling the first peripheral edge to the second peripheral edge.

27. The method of claim 25, further comprising inserting the panels of viscoelastic material and the plurality of loose pieces of filler material into a cover with a resealable slot and sealing the slot to keep the material within the cover.

28. The method of claim 25, further comprising shredding material into individual lengths to form the filler material.

* * * * *